US006426699B1

(12) United States Patent
Porter

(10) Patent No.: US 6,426,699 B1
(45) Date of Patent: Jul. 30, 2002

(54) COLLAPSIBLE STORAGE DEVICE FOR THE DELIVERY AND PICKUP OF GOODS

(76) Inventor: David Porter, 442 W. 62nd Ter., Kansas City, MO (US) 64113

( * ) Notice: Subject to any disclaimer, the term of this patent is extended or adjusted under 35 U.S.C. 154(b) by 0 days.

(21) Appl. No.: 09/453,378

(22) Filed: Dec. 2, 1999

Related U.S. Application Data

(60) Provisional application No. 60/110,681, filed on Dec. 2, 1998.

(51) Int. Cl.[7] ..... G08B 13/14

(52) U.S. Cl. ..... 340/568.1; 340/543; 340/5.9; 340/5.92; 221/2; 232/20; 232/21

(58) Field of Search ..... 340/568.1, 585, 340/543, 539, 693.5, 693.11, 569, 570, 825.31, 5.9, 5.92; 221/2, 6, 11; 211/4, 85, 88.02, 104, 126.6, 130.1, 132.1, 149, 167; 220/666, 667, 9.2, 9.3, 520, 521, 557, 720; 312/236, 245, 246, 247, 248; 232/19, 20, 21

(56) References Cited

U.S. PATENT DOCUMENTS

| | | | | |
|---|---|---|---|---|
| 2,088,806 A | | 8/1937 | Ottmann | |
| 3,130,395 A | | 4/1964 | Simjian | |
| 3,591,194 A | | 7/1971 | Vega | 280/47.26 |
| 3,865,269 A | * | 2/1975 | Coleman | 220/6 |
| 3,935,933 A | | 2/1976 | Tanaka et al. | |
| 4,166,343 A | * | 9/1979 | O'Brian et al. | 52/66 |
| 4,231,105 A | | 10/1980 | Schuller et al. | 364/900 |
| 4,272,757 A | | 6/1981 | McLaughlin et al. | 340/825.35 |
| 4,314,102 A | | 2/1982 | Lowe et al. | 179/217 |
| 4,354,613 A | | 10/1982 | Desai et al. | 221/4 |
| 4,369,442 A | | 1/1983 | Werth et al. | 340/825.35 |
| 4,419,734 A | | 12/1983 | Wolfson et al. | 364/567 |
| 4,553,211 A | | 11/1985 | Kawasaki et al. | 364/479 |
| 4,575,719 A | | 3/1986 | Bertagna et al. | 340/825.35 |
| 4,589,588 A | * | 5/1986 | Swanhart | 229/41 R |
| 4,596,203 A | | 6/1986 | Lorek | 116/215 |
| 4,629,090 A | * | 12/1986 | Harris et al. | 221/7 |
| 4,706,794 A | | 11/1987 | Awane et al. | 194/217 |
| 4,750,197 A | | 6/1988 | Denekamp et al. | 379/58 |
| 4,767,917 A | | 8/1988 | Ushikubo | 235/381 |
| 4,789,293 A | | 12/1988 | Hashimoto et al. | 414/273 |
| 4,791,411 A | * | 12/1988 | Staar | 340/568.1 |
| 4,792,270 A | | 12/1988 | Yoshida | 414/273 |
| 4,812,629 A | | 3/1989 | O'Neil et al. | 235/383 |
| 4,814,592 A | | 3/1989 | Bradt et al. | 235/381 |
| 4,834,231 A | | 5/1989 | Awane et al. | 194/217 |
| 4,839,505 A | | 6/1989 | Bradt et al. | 235/381 |
| 4,896,024 A | | 1/1990 | Morello et al. | 235/381 |
| 4,961,507 A | | 10/1990 | Higgins | 221/129 |
| 5,009,018 A | | 4/1991 | Sebag | 40/306 |
| 5,014,875 A | | 5/1991 | McLaughlin et al. | 221/2 |
| 5,036,310 A | | 7/1991 | Russell | 340/569 |
| 5,079,539 A | | 1/1992 | Hatori | 340/568.1 |
| 5,088,586 A | | 2/1992 | Isobe et al. | 194/205 |
| 5,091,713 A | | 2/1992 | Horne et al. | 340/541 |
| 5,118,175 A | | 6/1992 | Costello | 312/242 |
| 5,153,561 A | | 10/1992 | Johnson | 340/571 |
| 5,159,560 A | | 10/1992 | Newell et al. | 364/479 |
| 5,175,690 A | | 12/1992 | Berthier et al. | 364/478 |

(List continued on next page.)

FOREIGN PATENT DOCUMENTS

| | | |
|---|---|---|
| DE | 3914686 | 3/1991 |
| GB | 2269469 | 2/1994 |

*Primary Examiner*—Daniel J. Wu
*Assistant Examiner*—Toan Pham
(74) *Attorney, Agent, or Firm*—Hovey Williams LLP

(57) ABSTRACT

A storage device (10, 100) configured to be mounted to or near a house or other building for storing delivered goods. The storage device is shiftable between an expanded position wherein the device occupies a relatively large amount of space when in use and a collapsed position wherein the storage device occupies a relatively small amount of space when not in use.

19 Claims, 5 Drawing Sheets

U.S. PATENT DOCUMENTS

| | | | | | |
|---|---|---|---|---|---|
| 5,190,213 | A | | 3/1993 | Horwitz | 229/152 |
| 5,205,436 | A | | 4/1993 | Savage | 221/7 |
| 5,223,829 | A | | 6/1993 | Watabe | 340/825.31 |
| 5,247,282 | A | | 9/1993 | Marshall | 340/569 |
| 5,253,763 | A | * | 10/1993 | Kirkley et al. | 206/600 |
| 5,257,509 | A | | 11/1993 | Harris | 62/326 |
| 5,263,339 | A | | 11/1993 | Evans | 62/457.7 |
| 5,270,686 | A | | 12/1993 | Martinez | 340/689 |
| 5,313,393 | A | | 5/1994 | Varley et al. | 364/403 |
| 5,377,906 | A | | 1/1995 | Mason | 232/34 |
| 5,385,265 | A | | 1/1995 | Schlamp | 221/7 |
| 5,386,462 | A | | 1/1995 | Schlamp | 379/106 |
| 5,407,218 | A | | 4/1995 | Jackson | 280/30 |
| 5,431,250 | A | | 7/1995 | Schlamp | 186/55 |
| 5,467,892 | A | | 11/1995 | Schlamp | 221/7 |
| 5,482,139 | A | * | 1/1996 | Rivalto | 186/36 |
| 5,485,139 | A | | 1/1996 | Tarnovsky | 340/573.1 |
| 5,502,944 | A | | 4/1996 | Kraft et al. | 53/55 |
| 5,608,193 | A | | 3/1997 | Almogaibil | 177/25.13 |
| 5,748,485 | A | | 5/1998 | Christiansen et al. | 364/479.04 |
| 5,774,053 | A | * | 6/1998 | Porter | 340/568.1 |
| 5,790,409 | A | | 8/1998 | Fedor et al. | 364/479.02 |
| 5,910,163 | A | | 6/1999 | Schlamp | 62/256 |
| 5,913,448 | A | * | 6/1999 | Mann et al. | 220/666 |
| 5,917,411 | A | | 6/1999 | Baggarly | 340/569 |
| 5,941,400 | A | * | 8/1999 | Lemaire | 211/201 |
| 5,941,405 | A | * | 8/1999 | Scales et al. | 220/1.5 |
| 5,950,919 | A | | 9/1999 | Adams | 232/34 |
| 5,963,134 | A | | 10/1999 | Bowers et al. | 340/572.1 |
| 5,988,346 | A | * | 11/1999 | Tedesco et al. | 194/217 |
| 6,056,177 | A | * | 5/2000 | Schneider | 224/401 |
| 6,204,763 | B1 | * | 3/2001 | Sone | 340/568.1 |

* cited by examiner

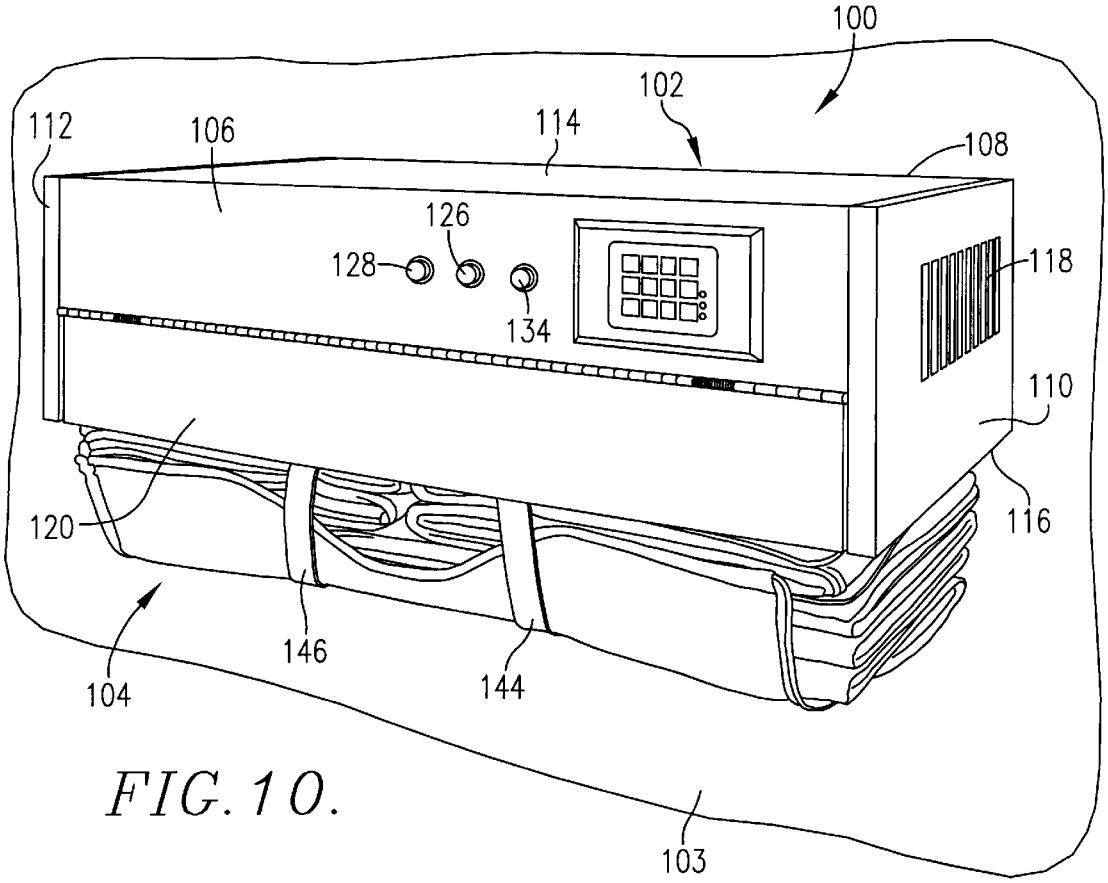
FIG. 10.
FIG. 11.
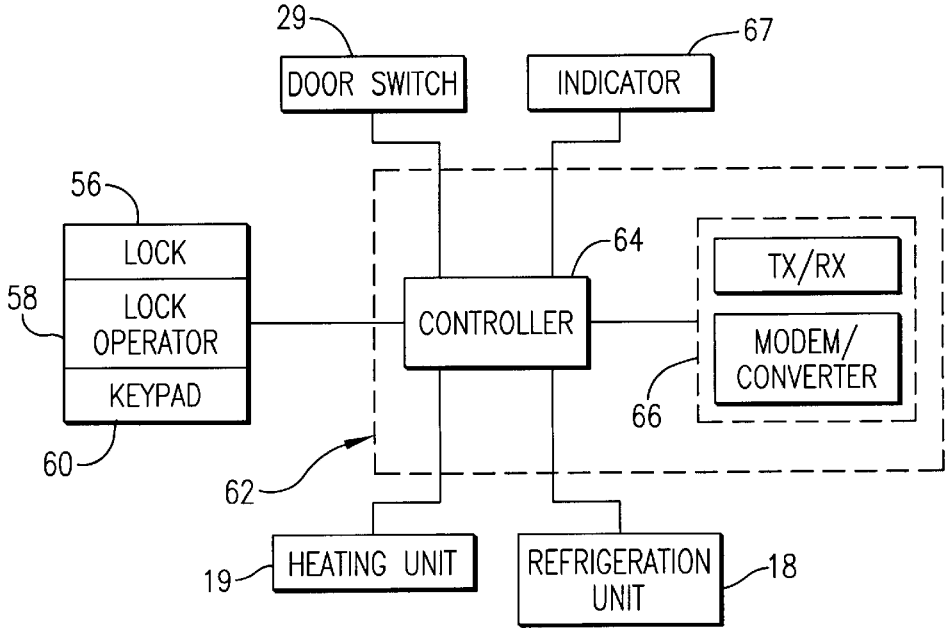

COLLAPSIBLE STORAGE DEVICE FOR THE DELIVERY AND PICKUP OF GOODS

RELATED APPLICATION

This application claims the benefit of provisional application entitled Collapsible Storage Device for the Delivery and Pickup of Goods, Ser. No. 60/110,681, filed Dec. 2, 1998, incorporated into the present application by reference.

BACKGROUND OF THE INVENTION

1. Field of the Invention

The present invention relates to storage devices for holding goods that are delivered or to be picked up. More particularly, the invention relates to a storage device that has ample room for storing delivered goods when in use and that may be selectively collapsed to occupy a smaller space when not in use.

2. Description of Related Art

Home delivery of goods has become an increasingly popular way for consumers to reduce shopping time. Many retail stores allow consumers to order clothes, appliances, furniture and other goods from catalogues for direct delivery to their homes. Similarly, many laundry and dry cleaning businesses pick up and deliver laundry directly to consumers— homes, and many grocery stores deliver groceries directly to consumers homes.

The rapid growth of the Internet has further increased the home delivery industry. Many retailers such as Amazon.com permit consumers to see images of and order goods from the Internet. The goods are then shipped directly from the manufacturer to the consumer rather than to a conventional retail store.

To secure delivered goods from theft and damage, lockable storage devices for enclosing the goods have been developed. These devices typically include fixed walls forming an enclosure big enough to hold a variety of items including groceries, packages and dry cleaning. Unfortunately, however, when the devices are not in use, they may take up unnecessary space.

SUMMARY OF THE INVENTION

Accordingly, there is a need for a storage device that has ample room for the storage of items when it is in use but that occupies a smaller space when not in use. The present invention solves the above-described problems and provides a distinct advance in the art of storage devices for delivered goods. More particularly, the present invention provides a storage device that has ample room for the storage of a variety of delivered goods when in use and that may be selectively collapsed or folded to occupy a smaller space when not in use.

One embodiment of the storage device broadly includes a lower section and an upper section both including walls defining an enclosed space for holding delivered goods. The walls are configured so that they may be selectively shifted between an expanded position when in use and a collapsed position when not in use. Moreover, the storage device may include a mechanism for permitting one of the lower and upper sections to be stored within the other section when the sections are collapsed to further reduce the space occupied by the storage device.

Another embodiment of the storage device broadly includes a hood configured for mounting to a wall or other support and an enclosure depending from the hood. The enclosure also may include a plurality of foldable walls that may be unfolded to a fully expanded position beneath the hood for holding goods when in use and then folded to a compact position below the hood when not in use.

Both embodiments of the storage device may also include a refrigeration unit for chilling goods or a heating unit for heating goods stored therein. Both embodiments also preferably include a lock for locking the device, a lock operator for operating the lock, an input device such as a keypad operable by a person to control the lock operator, and a communication and control apparatus for controlling entry to the enclosure and for providing a notification that goods have been delivered to or picked up from the storage device.

Other objects, features and advantages will be understood by persons skilled in the art in view of the following detailed description and the accompanying drawings.

BRIEF DESCRIPTION OF THE DRAWINGS

The present invention is illustrated in the drawing figures wherein:

FIG. 10 is an isometric view of the storage device of FIG. 8 shown in its fully collapsed state; and FIG. 11 is a schematic diagram of control elements of the first and second preferred embodiments of the storage device.

DETAILED DESCRIPTION OF PREFERRED EMBODIMENTS

FIGS. 1–7 and 11 illustrate a storage device 10 constructed in accordance with a first preferred embodiment of the present invention. The storage device is configured for mounting to a frame 12 which is in turn mounted to the exterior wall of a house or other building and is shiftable between a fully collapsed position illustrated in FIG. 1 and a fully expanded position illustrated in FIG. 2. This enables the device to be squeezed shut and pressed thin against the building when it is not in use and then expanded out and up when goods such as laundry and/or groceries are to be placed therein.

Figure 3:
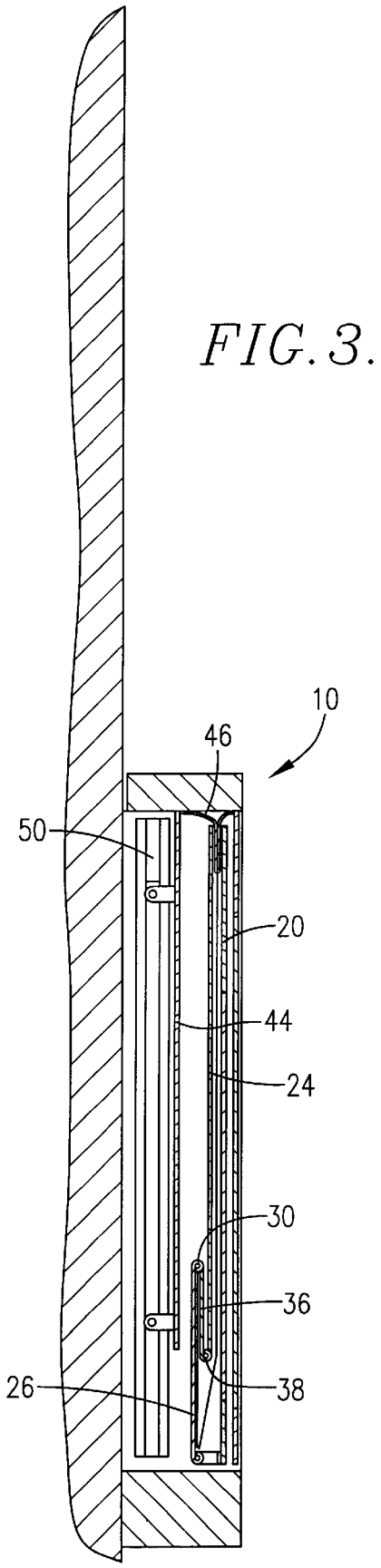
FIG. 3 is a vertical sectional view of the storage device of FIG. 1 in its fully collapsed state.
Figure 4:
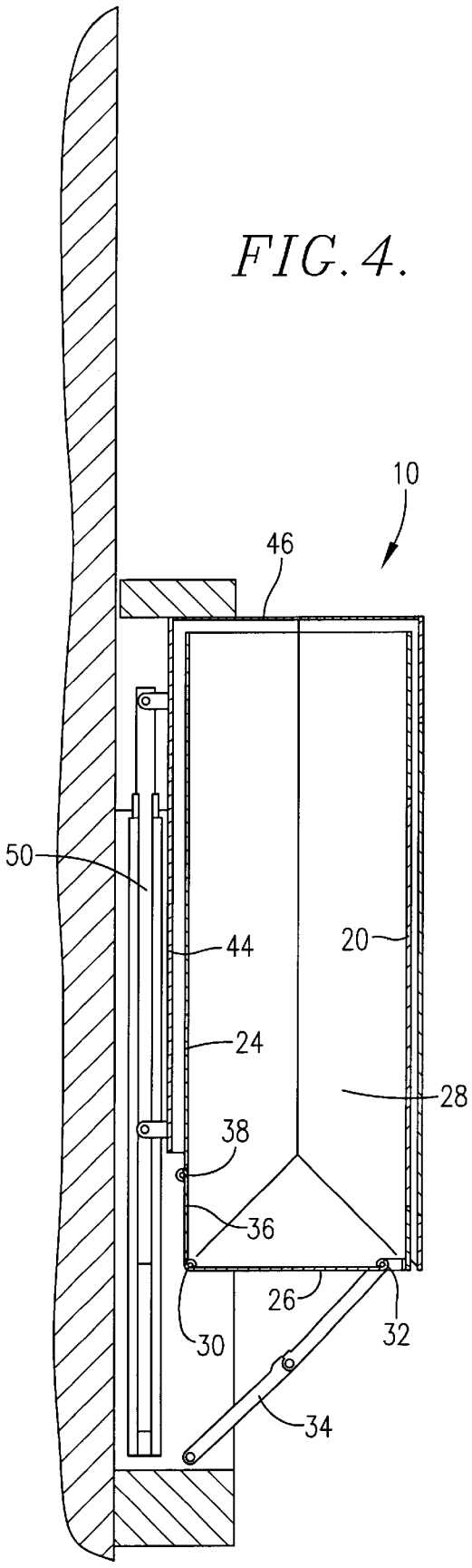
FIG. 4 is a vertical sectional view of the storage device of FIG. 1 after it has been partially expanded.

The device 10 broadly includes a lower section 14, an upper section 16, and an optional refrigeration unit 18. The lower section is positioned within the confines of the upper section when the device is in its fully collapsed position and can be expanded outwardly away from the building, as illustrated in FIGS. 3 and 4, when the device is in use. The upper section fits over the lower section when the device is collapsed and may be expanded both outwardly away from the building and upwardly above the lower section.

In more detail, the lower section 14 includes a front wall 20 having a hinged door 22 therein, a rear wall 24, a bottom wall 26, and a pair of flexible, foldable sidewalls 28. A door switch 29 (FIG. 11) may be mounted adjacent the door for sensing opening and closing of the door.

Figure 5:
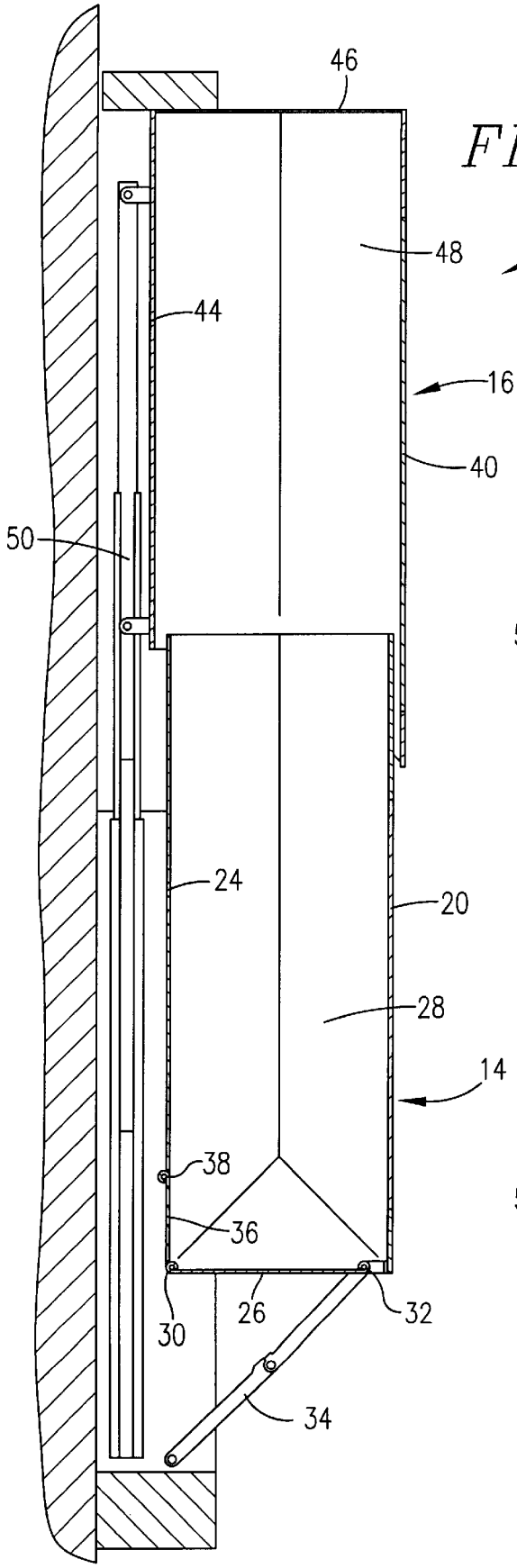
FIG. 5 is a vertical sectional view of the storage device of FIG. 1 in its fully expanded state.
Figure 6:
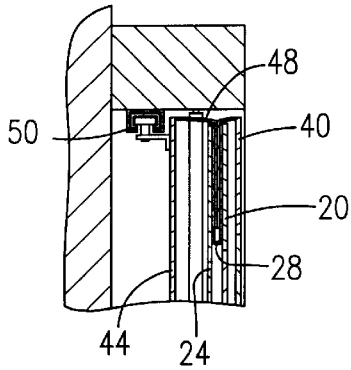
FIG. 6 is a fragmentary horizontal sectional view of the right side of the storage device of FIG. 1 in its fully collapsed state.
Figure 7:
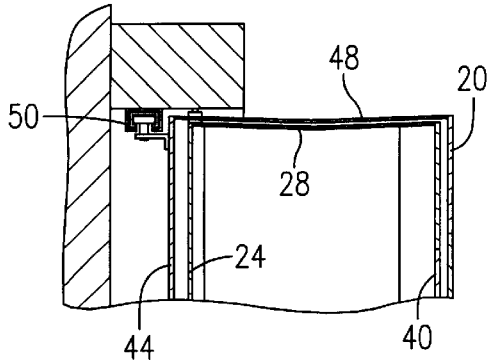
FIG. 7 is a fragmentary horizontal sectional view of the right side of the storage device of FIG. 1 in its fully expanded state.

As illustrated in FIGS. 3 and 4, the inside edge of the bottom wall 26 is mounted to a fixed pivot rod 30 and the outside edge is mounted to a movable pivot rod 32. The ends of the moveable pivot rod 32 are in turn connected to a pair of foldable over-the-center braces 34. The lower portion of the rear wall 24 includes a foldable segment 36 connected between the fixed pivot 30 and another movable pivot 38. The bottom wall 26, sidewalls 28, braces 34 and foldable segment 36 each may unfold when the lower section is expanded, as illustrated in FIGS. 4 and 5. As best illustrated in FIG. 2, one of the sidewalls 28 and the frame 12 may have a port formed therein for introducing chilled air into the device from the refrigeration unit 18.

The upper section 16 includes a front wall 40 having a hinged door 42 therein, a rear wall 44, a flexible, foldable top wall 46, and a pair of flexible, foldable sidewalls 48. As illustrated in FIG. 2, the sidewalls 48 may be supported by a pair of foldable struts 52. As illustrated in FIGS. 4 and 5, the rear wall is mounted to a pair of telescoping guides or rails 50 that guide and support the upper section when it is expanded upwardly above the lower section.

Figure 2:
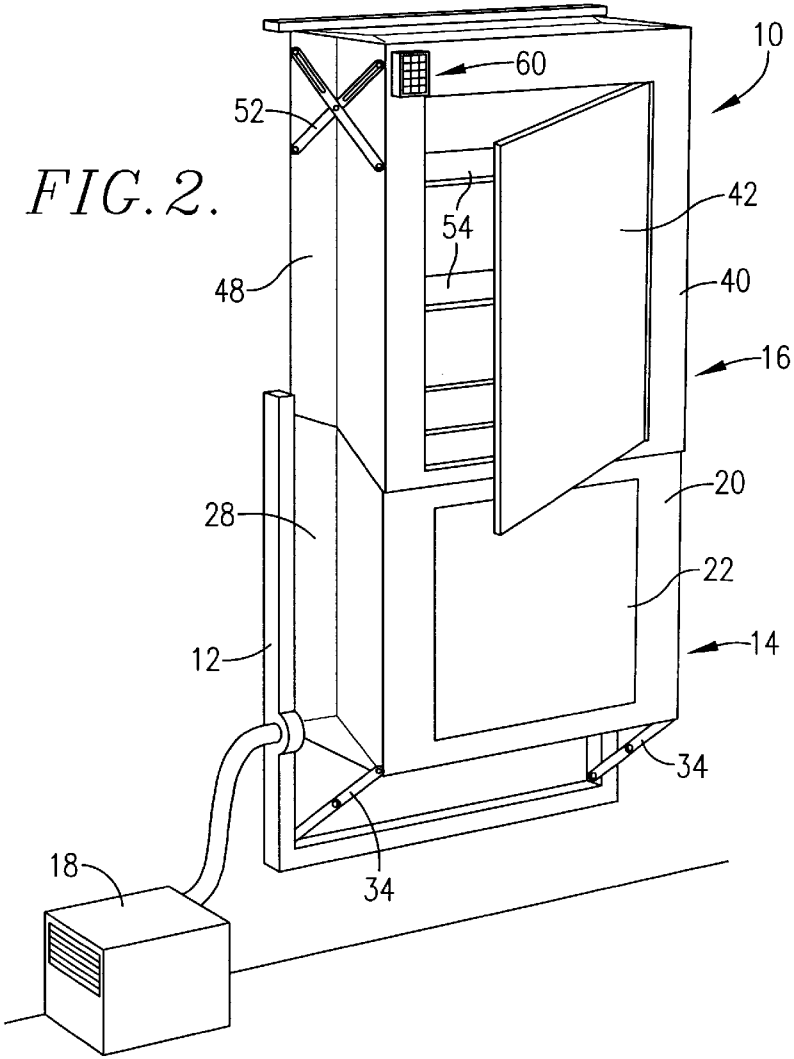
FIG. 2 is an isometric view of the storage device of FIG. 1 shown in its fully expanded state.
Figure 1:
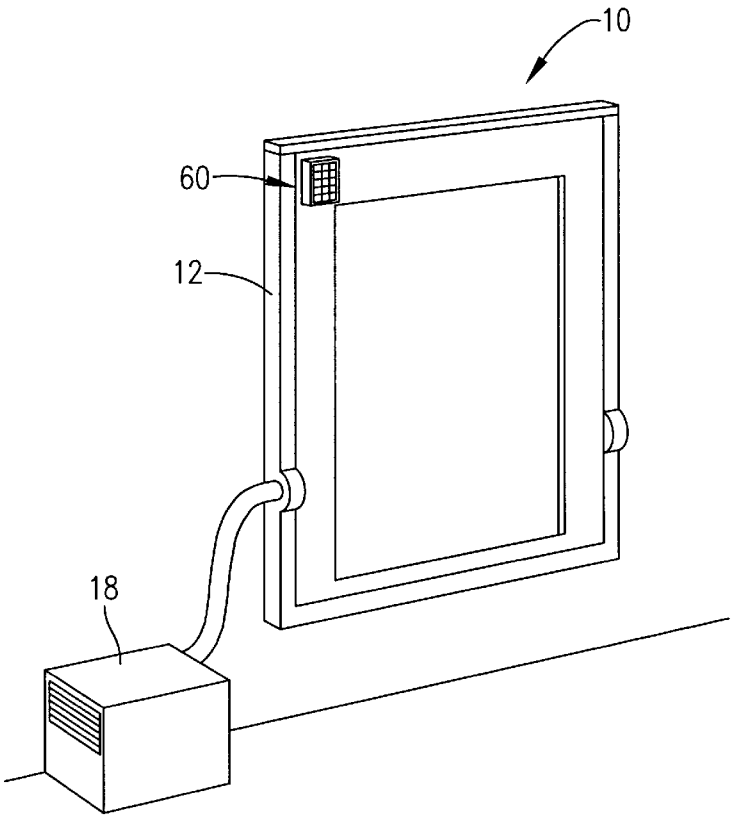
FIG. 1 is an isometric view of a storage device constructed in accordance with a first preferred embodiment shown in its fully collapsed state.

As illustrated in FIG. 2, the storage device 10 also may include collapsible, hinged shelves 54, or garment hooks, or a combination thereof. The hinged shelves are folded down, so that they are positioned vertically against the front or rear wall when the storage device is collapsed, but then are folded out and supported by a latch or other mechanism on the opposite wall when the device is expanded.

The refrigeration unit 18 is preferably configured to fit adjacent to or under the lower section 14 but also may be positioned remotely such as inside the building to which the device is attached. Alternatively, refrigeration unit 18 may be part of an existing refrigerator or refrigeration device located inside the building. The modularity of this design allows the storage device to be sold either with or without the refrigeration unit. The device also may be equipped with a similar heating unit 19 (FIG. 11) for keeping delivered foods warm. As with refrigeration unit 18, heating unit 19 may be positioned adjacent to or under the lower section 14 or remotely to lower section 14. Further, heating unit 18 may be part of an existing heating device located within the building.

As illustrated in FIG. 11, the storage device 10 includes a lock 56 for locking the door 42 and a lock operator 58 for locking and unlocking the lock. In preferred forms, the lock operator includes an input device such as a alphanumeric keypad 60 for permitting the entry of keycodes. As described in more detail below, the lock operator unlocks the lock only when a correct keycode is entered into the keypad. The lock operator also may be coupled with other types of entry controlling devices such as a card reader, voice recognition device, fingerprint identification system, infrared sensor, bar code reader, or radio signal controlled or contactless smart card having a computer microchip embedded thereon, or the like.

In preferred forms, the storage device 10 also includes a communication and control apparatus 62 for controlling access to the device and for providing notification that goods have been delivered to or picked up from the device. As illustrated in FIG. 11, the preferred communication and control apparatus broadly includes a controller 64 and a transmitting device 66. The communication and control apparatus is described in more detail in U.S. Pat. No. 5,774,053, which is incorporated herein by reference. The components of controller 64 may be proximately or remotely located with respect to upper and lower sections 14 and 16.

As illustrated in FIG. 11, the controller 64 is operably coupled with the keypad 60, the door lock operator 58, the door switch 29, an indicator 67, the refrigeration unit 18, and the heating unit 19. The controller and the other powered components of the storage device receive electrical power from an AC or DC power source such as a 120v AC outlet or a solar cell. The storage device also may include a battery for providing backup operation of the device in case of a power failure.

The controller 64 is preferably a programmable logic controller (PLC), a microcomputer or other microprocessor device, but may also be a home security system controller, such as those manufactured and sold by the ADT Corporation or Brinks Security Corporation, that is programmed to operate as described herein. The controller has a memory device for storing a plurality of vendor codes. A permanent or temporary vendor code is assigned to each vendor that delivers goods to or picks up goods from the storage device. For example, a laundry and dry cleaning business may be assigned a vendor code of 333, whereas a local grocery store may be assigned a vendor code of 444. Numerous other vendors also may be assigned unique vendor codes. All of these vendor codes are stored in the memory device of the controller. Vendor codes may include transaction codes comprising codes identifying a vendor, a vended item or items, and a delivery agent.

For further security, each vendor also may assign each of their delivery people with their own unique employee code. This permits the controller 64 to not only identify which vendor makes deliveries, but also to identify which delivery person employed by the vendor is making the delivery.

A plurality of vendor messages, each of which may be associated with a particular vendor code, also are preferably stored in the memory device of the controller 64. For example, the message "Laundry has been delivered" may be stored in association with the vendor code 333 for the laundry and dry cleaning business, and the message "Groceries have been delivered" may be stored in association with the vendor code 444 for the grocery store. The vendor messages may be audio messages stored on an audio tape device, such as a telephone answering machine coupled with or internal to the controller, or may be digitized and stored in the memory device of the controller.

The transmitting device 66 is coupled with and responsive to the controller 64 and is operable for sending the vendor messages to remote locations whenever a delivery has been made. The transmitting device 66 may be a communication device such as a telephone, programmable answering machine, modem, DSL converter, or ISDN converter configured for sending analog or digital messages over a conventional telecommunications network such as a telephone line, a local area network, or a wide area network. The transmitting device 66 may also be an electromagnetic signal transmitter/receiver for transmitting the vendor messages over a wireless network, eg., a radio network.

The communication and control apparatus 62 also may include an alarm, such as a rotating or flashing light, a horn, or bell for security. The controller 64 may be programmed to activate the alarm if the door 22 of the device is forced open or if a person otherwise tampers with the storage device 10 without first entering a valid vendor code or homeowner code. The controller also may be programmed to send an alarm message to the police or a security company if any of these alarm conditions occur. Alternatively, if controller 64 is part of a home security system, an attempt to force open the device may trigger alarms and indications associated with the home security system.

The communication and control apparatus 62 is preferably part of a delivery system that allows messages to be sent to and received from several locations remote from the enclosure. For example, a remote communications apparatus may be placed in the homeowner's home and another remote communication apparatus may be positioned in a vendor's business. The remote communication apparatuses are similar to the communication and control apparatus 62 and each includes controller 64 and transmitting device 66.

In operation, a vendor makes a delivery to the storage device 10 by first entering a keycode into the keypad 60. The controller 64 compares the keycode to the stored vendor codes and instructs the lock operator 58 to unlock the lock 56 only if the keycode matches one of the vendor codes.

If the entered keycode matches a vendor code, the controller 64 also retrieves the vendor message associated with the matched vendor code and sends it to the transmitting device 66 for transmitting to one or both of the remote communication apparatuses. Transmitter and receiver devices or transceiving devices of the remote communication apparatuses receive the vendor message, demodulate or otherwise process the message, and send the message to their respective controllers. The remote controllers then display the message or otherwise indicate that a delivery has been made.

The communication and control apparatus 62 and the remote communication apparatuses also may be configured to permit the homeowner to send a message or notification to a vendor that goods are available for pickup. For this operation, a plurality of unique homeowner codes and a plurality of homeowner messages are stored in the memory of the controller 64. For example, the homeowner code 555 and the homeowner message "Please pick up laundry at XXXX Street" may be stored in the controller for notifying a laundry business that laundry needs to be picked up.

Whenever the homeowner wishes to have goods picked up from the storage device 10, he or she merely enters one of these homeowner codes into the keypad 60. The controller 64 then determines if the entered homeowner code matches one of the stored homeowner codes. If it does, the controller unlocks the lock operator 58, retrieves the homeowner message associated with the homeowner code, and directs the transmitting device 66 to transmit the homeowner message to the appropriate remote communication apparatus, i.e., the remote communication apparatus positioned at the appropriate vendor.

The vendor codes, employee codes, and homeowner codes stored in the controller 64 may be changed by either the vendors or the homeowner, or both, by entering corrected codes. Additionally, new codes can be added to the controller and unused codes may be deleted. Such corrections, additions, and deletions may be entered using the input/output devices described above, including an Internet access appliance or a personal computer.

The communication and control apparatus 62 and the remote communication apparatuses also may be configured for permitting the delivery of goods ordered from the Internet. For example, a customer may access a vendor's Internet website and place an order for the purchase of goods. Along with the order, the customer may send a one-time vendor code to the vendor that authorizes the vendor or the vendor's delivery person to deliver the goods to the storage device. The controller 64 of the communication apparatus may be programmed to not only unlock the front door 42 upon entry of the vendor code, but to also send a notification message to the customer and a payment message to the vendor to charge or debit the customer's account for the price of the goods.

The communication and control apparatus 62 also may include memory for storing delivery and pickup information such as a history of the deliveries made to the storage device and input/output devices, such as those described above, for permitting the homeowner to access this information.

The controller 64 may preferably be programed so that, whenever a particular vendor code is entered into the keypad 60, it automatically turns on the refrigeration unit 18. For example, if the vendor code 444 for the grocery store is entered into the keypad, the controller may be programmed to not only unlock the door lock 56 and transmit a vendor message to indicate that a delivery has been made, but to also turn on the refrigeration unit. The refrigeration unit may be on a timer so that it runs only a predetermined amount of time or may include a switch that permits the homeowner to turn it off once the goods have been retrieved from the storage device 10.

The controller 64 also may be programmed for receiving a code from the homeowner to turn on the refrigeration unit 18 or the heating unit 19 a predetermined amount of time before a delivery is made. This permits the refrigeration unit or heating unit to cool or heat the interior of the enclosure before the goods are delivered. Alternatively, the vendor may be instructed to telephone in or otherwise transmit his vendor code to the controller before delivery is made for turning on the refrigeration unit or heating unit.

The controller 64 also may be coupled with the indicator 67 to activate the indicator whenever a delivery has been made. This provides the homeowner with a visual indication of the status of the storage device.

FIGS. 8–11 illustrate a storage device 100 constructed in accordance with a second preferred embodiment of the present invention. The storage device broadly includes a hood 102 configured for mounting to a wall 103 of a house or other building and an enclosure 104 depending from the hood for storing goods therein.

In more detail, the hood 102 includes a front wall 106, a rear wall 108, a pair of side walls 110, 112, a top wall 114, and a bottom wall 116, all formed of wood, fiberglass, synthetic resin materials, or any other strong and weather resistant material. The walls together may define a substantially rectangular-shaped housing for enclosing certain control elements described below. Alternatively, the shape of the housing may be altered, and the control elements may be located remotely.

The hood rear wall 108 is configured to be bolted or otherwise attached to the wall 103 so that the hood is mounted about 4 to 6 feet (about 1.2 to 1.8 meters) above the floor. Alternately, the hood may be mounted to a rack or other support assembly that elevates the hood above the floor.

Figure 9:
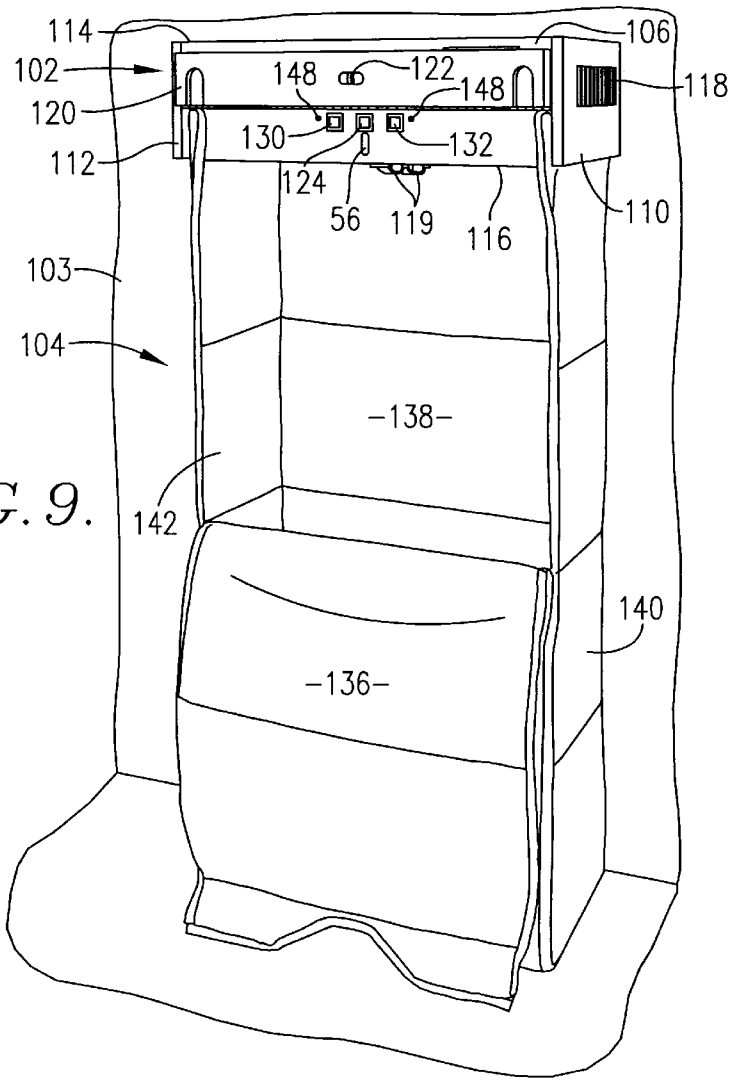
FIG. 9 is an isometric view of the storage device of FIG. 8 shown with its front wall opened for permitting delivery or removal of goods therefrom.
Figure 8:
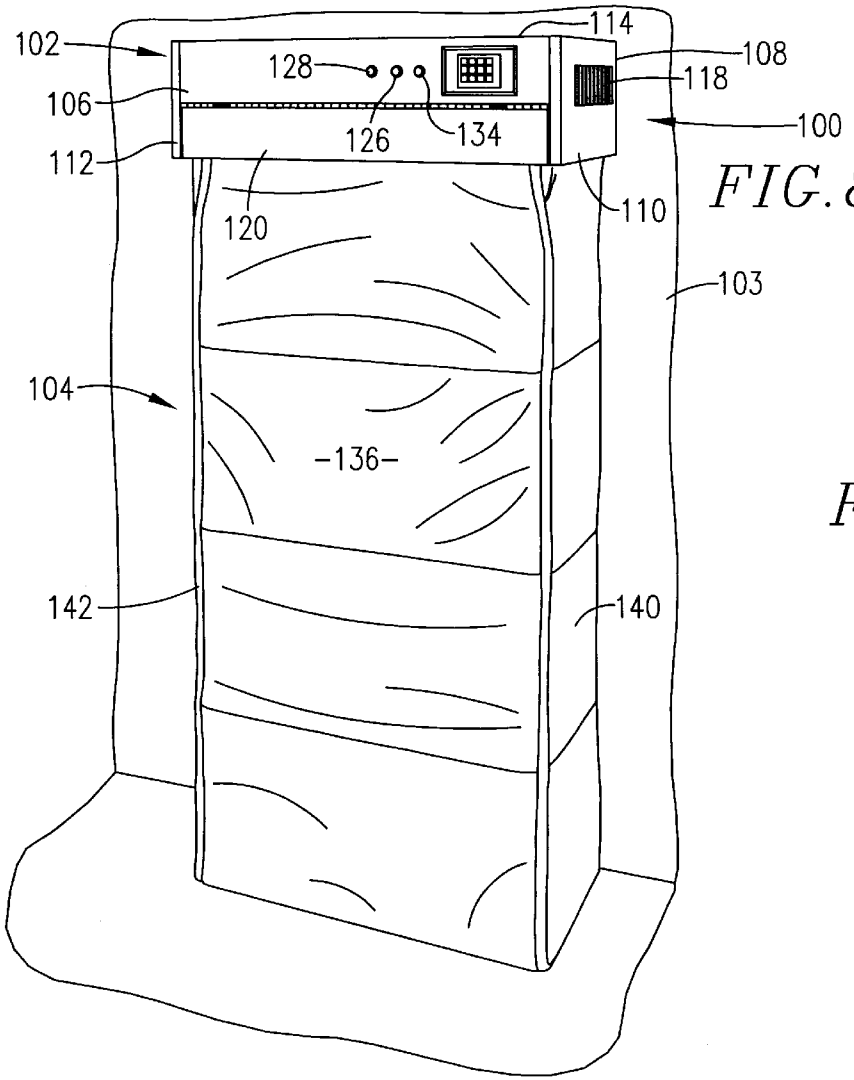
FIG. 8 is an isometric view of a storage device constructed in accordance with a second preferred embodiment shown in its fully expanded state.

Each of the side walls 110, 112 may include a plurality of air slots or vents 118 for convecting heat away from the control elements mounted within the hood. Similar vents may be positioned in the top and bottom walls. As illustrated in FIG. 9, the bottom wall includes a plurality of garment hooks 119 or a hangar rod depending therefrom for holding delivered laundry and dry cleaning.

The front wall 106 of the hood includes a hinged panel 120 that may be selectively raised to permit access to the enclosure and certain switches or lowered to prevent access to the enclosure and switches, as described below. A latch 122 is attached to the panel for receipt within a corresponding lock mechanism 56 positioned within the hood for preventing raising of the panel. As illustrated in FIG. 11, the lock is coupled with a lock operator 58 which may include an input device such as a conventional alpha numeric keypad 60. The lock operator is in turn coupled with a communication and control apparatus 62. The lock, lock operator, and communication and control apparatus operate in the same manner as the same-numbered components described in connection with the first embodiment of the storage device.

The hood 102 also may preferably be equipped with an interior light and associated control switch 124 and indicator 126 positioned on the front wall 106 for illuminating the interior of the enclosure. The hood also may include a delivery indicator light 128 and associated switch 130 positioned on the front wall that may be operated by a vendor to indicate that a delivery has been made or that may be operated by the owner of the storage device to indicate that goods are positioned in the enclosure for pickup.

To maintain the temperature of food items placed within the enclosure 104, the storage device 100 preferably includes a refrigeration unit 18 and/or heating unit 19 mounted in the hood 102 for introducing chilled or heated air into the enclosure 104. The refrigeration and/or heating unit is coupled with an on/off switch 132 or a thermostat and an associated indicator light 134 positioned on the front wall of the hood.

The enclosure 104 depends from the hood 102 and includes a plurality of foldable walls that may be unfolded to a fully expanded position beneath the hood (FIGS. 8 and 9) for holding goods when in use and then folded to a compact position below the hood (FIG. 10) when not in use. The walls are preferably formed of flexible insulative material to maintain the temperature of items placed therein.

In more detail, the enclosure 104 includes a front wall 136, a rear wall 138, and a pair of opposed side walls 140, 142. Each wall includes a plurality of fan-foldable panels that may be unfolded to their fully expanded positions illustrated in FIGS. 8 and 9 or folded to their fully collapsed and folded positions illustrated in FIG. 10. The periphery of each wall includes zipper teeth that can be attached to the zipper teeth on adjacent walls by a plurality of zipper slider tabs for releasably attaching the walls together as described in more detail below. The front wall of the enclosure forms a door that may be opened by unfastening the zippers between the front and side walls to permit entry into the enclosure, as depicted in FIG. 9.

A pair of straps 144, 146, each having one of its ends attached to the hood 102 or to the enclosure rear wall, hold the fully folded walls in their collapsed position beneath the hood. Each of the straps includes a snap on its free end that may be connected to a corresponding snap-socket 148 (see FIG. 9) attached to the front wall of the hood.

In operation, the storage device 100 is typically positioned in its collapsed or folded position illustrated in FIG. 10 when not in use. When a vendor desires to make a delivery to the storage device, the vendor first enters a keycode into the keypad 60. The controller 64 compares the keycode to the stored vendor codes and unlocks the lock 56 holding the panel 120 on the front wall of the hood in its lowered, locked position only if the keycode matches one of the vendor codes. Components of the controller 64 may be located proximately or remotely to the enclosure 104. When unlocked, the panel 120 may be raised to expose the snaps on the straps 144, 146, the switches 124, 130, 132, and the slide tabs of the zippers.

The vendor then unfastens the straps 144, 146, unfolds the walls 136, 138, 140, 142, and connects the walls with the zippers, so that the enclosure assumes the orientation illustrated in FIG. 10. The vendor then places the delivered goods within the enclosure and closes the front wall of the enclosure by fully raising the slide tabs on the zippers. The vendor may turn on the refrigeration unit 18 or heating unit 19 by operating the switch 132 (or by activating the thermostat) to keep groceries or food items cool or warm and may activate the delivery indicator light 128 by operating the switch 130. Finally, the vendor closes and locks the panel 120 on the front wall of the hood to prevent access to the straps and zippers and, therefore, prevent unauthorized opening of the enclosure.

While the vendor is placing goods in the enclosure 104, the controller 64 notifies the owner or user of the storage device of the delivery of the goods as described in connection with the first embodiment of the storage device. The owner may then remove the goods stored in the storage device by repeating the above-described steps and may then once again fold the walls of the enclosure so that the enclosure is in its fully folded or collapsed position illustrated in FIG. 10.

Although the invention has been described with reference to preferred embodiments illustrated in the attached drawings, it is noted that equivalents may be employed and substitutions made herein without departing from the scope of the invention as recited in the claims. For example, both storage devices 10, 100 may be constructed in many shapes and styles and of many materials. Moreover, the particular mechanisms for permitting folding and collapsing of the storage devices 10, 100 may be replaced with other mechanisms that provide the same functions.

Having thus described the preferred embodiment of the invention, what is claimed as new and desired to be protected by Letters Patent includes the following:

1. A storage device for the delivery and pickup of goods, the storage device comprising:

a lower section including a plurality of walls defining an enclosed space for holding the goods; and mechanism operably coupled with the walls to permit the walls to be shifted between an expanded position and a collapsed position;

an upper section including a plurality of walls defining an enclosed space for holding the goods; and mechanism operably coupled with the walls to permit the walls to be shifted between an expanded position wherein the upper section occupies a predetermined amount of space when in use and a collapsed position wherein the upper section occupies a relatively smaller amount of space when not in use; and mechanism operably coupling the lower section to the upper section and permitting one of the lower and upper sections to be inserted into the other section to further reduce the amount of space occupied by the storage device when not in use.

2. The storage device as set forth in claim 1, the walls being formed of flexible material.

3. The storage device as set forth in claim 1, the walls of the lower section including a front wall having a hinged door therein, a rear wall, a bottom wall, and a pair of foldable side walls.

4. The storage device as set forth in claim 3, the mechanism of the lower section including a pair of pivot rods operably coupled with the bottom wall.

5. The storage device as set forth in claim 4, the mechanism of the lower section further including a pair of foldable over-the-center braces coupled with one of the pivot rods.

6. The storage device as set forth in claim 1, further including a plurality of foldable shelves for supporting the goods thereon.

7. The storage device as set forth in claim 1, further including a refrigeration unit for introducing chilled air into the lower and upper sections.

8. The storage device as set forth in claim 1, further including a heating unit for introducing heated air into the lower and upper sections.

9. The storage device as set forth in claim 1, further including a lock operator for unlocking the lock, the lock operator including an input device operable by a person to cause the lock operator to unlock the lock.

10. The storage device as set forth in claim 9, further including a communication and control apparatus operably coupled with the lock operator for controlling entry to the enclosure and for providing a notification that goods have been delivered to or picked up from the enclosure.

11. The storage device as set forth in claim 10, the communication and control apparatus including a controller coupled with the input device, the controller including memory for storing a plurality of vendor codes each associated with a separate vendor, a comparator for comparing a key code entered into the input device to the vendor codes to determine if the key code matches one of the vendor codes, and an activator for activating the lock operator for unlocking the lock if the key code matches one of the vendor codes .

12. A storage device for the delivery and pickup of goods, the storage device comprising:

a hood comprising a controller, wherein the hood is configured for mounting to a support; and a plurality of foldable walls defining an enclosure suspended from the hood, wherein the walls are shiftable between an expanded position and a folded position.

13. The storage device as set forth in claim 12, wherein one of the walls forms a door that is opened to permit access into the enclosure.

14. The storage device as set forth in claim 13, further including a lock operably coupled with the door for locking the door.

15. The storage device as set forth in claim 12, the hood further including a refrigeration unit for introducing chilled air into the enclosure.

16. The storage device as set forth in claim 12, the hood further including a heating unit for introducing heated air into the enclosure.

17. The storage device as set forth in claim 12, further including a lock operator for unlocking the lock, the lock operator including an input device operable to cause the lock operator to unlock the lock.

18. The storage device as set forth in claim 17, the hood further including a communication and control apparatus operably coupled with the lock operator for controlling entry to the enclosure and for providing a notification that goods have been delivered to or picked up from the enclosure.

19. The storage device as set forth in claim 18, the communication and control apparatus including a controller coupled with the input device, the controller including memory for storing a plurality of vendor codes each associated with a separate vendor, a comparator for comparing a key code entered into the input device to the vendor codes to determine if the key code matches one of the vendor codes, and an activator for activating the lock operator for unlocking the lock if the key code matches one of the vendor codes.

* * * * *